US006622803B2

(12) United States Patent
Harvey et al.

(10) Patent No.: US 6,622,803 B2
(45) Date of Patent: Sep. 23, 2003

(54) STABILIZER FOR USE IN A DRILL STRING

(75) Inventors: Peter R. Harvey, Tampa, FL (US); Michael J. Woods, Houston, TX (US); Steve J. Krase, Spring, TX (US); Daniel E. Burgess, Portland, CT (US); Mark Ellsworth Wassell, Kingswood, TX (US)

(73) Assignee: Rotary Drilling Technology, LLC, Houston, TX (US)

( * ) Notice: Subject to any disclaimer, the term of this patent is extended or adjusted under 35 U.S.C. 154(b) by 0 days.

(21) Appl. No.: 09/896,020

(22) Filed: Jun. 29, 2001

(65) Prior Publication Data

US 2002/0056574 A1 May 16, 2002

Related U.S. Application Data

(63) Continuation-in-part of application No. 09/532,725, filed on Mar. 22, 2000.

(51) Int. Cl.[7] ..... E21B 17/10

(52) U.S. Cl. ..... 175/325.3; 166/241.3; 166/381

(58) Field of Search ..... 166/250.01, 255.1, 166/255.2, 241.1, 241.2, 241.3, 381, 383; 175/57, 325.1, 325.5, 325.3

(56) References Cited

U.S. PATENT DOCUMENTS

| | | | | |
|---|---|---|---|---|
| 1,769,921 A | 7/1930 | Hansen | | |
| 1,959,368 A | 5/1934 | Kennedye | | 166/21 |
| 2,045,629 A | 6/1936 | Bettis | | 308/4 |
| 2,308,147 A | 1/1943 | Ballagh | | 308/4 |
| 2,671,641 A | 3/1954 | Hinkle | | 255/28 |
| 2,715,552 A | 8/1955 | Lane | | 308/4 |
| 2,877,062 A | 3/1959 | Hall | | 308/4 |
| 2,911,195 A | 11/1959 | Backer | | 255/73 |

(List continued on next page.)

FOREIGN PATENT DOCUMENTS

| | | | |
|---|---|---|---|
| EP | 0 058 061 | 8/1982 | |
| EP | 0457650 A2 * | 11/1991 | E21B/47/08 |
| GB | 2121453 A * | 12/1983 | E21B/7/08 |
| WO | WO 93/11334 | 6/1993 | |
| WO | WO 01/12945 | 2/2001 | |

OTHER PUBLICATIONS

Casto, R.G., et al., "Use of bicenter PDC bit reduces drilling cost," *Oil & Gas Journal*, Nov. 13, 1995, 92–96.

(List continued on next page.)

*Primary Examiner*—David Bagnell
*Assistant Examiner*—Jennifer H Gay
(74) *Attorney, Agent, or Firm*—Woodcock Washburn LLP

(57) ABSTRACT

A stabilizer especially adapted for use with an drill string having an eccentric drilling element, such as a bi-center bit. The stabilizer has a pair of circumferentially displaced blades that lie in a common circumferential plane and extend from a rotatable sleeve supported on the stabilizer body, as well as a stationary blade. The rotating blades are aligned with the stationary blade when in a first circumferential orientation and are disposed so that the mid-point between the rotating blades is located opposite the stationary blade, thereby providing full-gauge stabilization, when the rotating blades are in a second circumferential orientation. A magnetic systems senses the circumferential orientation of the rotating blades and transmits the information to the surface via mud pulse telemetry. A piston actuated by the drilling mud locks the rotating blades into the active and inactive positions. A brake shoe located on the distal end of each rotating blade provides contact with the walls of the bore hole and serves as a support pad for a formation sensor.

17 Claims, 10 Drawing Sheets

U.S. PATENT DOCUMENTS

| | | | | | |
|---|---|---|---|---|---|
| 2,971,582 | A | | 2/1961 | Marsh | 166/241 |
| 3,423,671 | A | | 1/1969 | Vezin | 324/1 |
| 3,588,199 | A | | 6/1971 | Hopmans | 308/4 A |
| 3,799,279 | A | | 3/1974 | Farris | 175/325 |
| 3,825,081 | A | | 7/1974 | McMahon | 175/73 |
| 3,916,998 | A | | 11/1975 | Bass, Jr. et al. | 166/301 |
| 3,942,824 | A | | 3/1976 | Sable | 285/45 |
| 4,071,101 | A | | 1/1978 | Ford | 175/325 |
| 4,071,285 | A | | 1/1978 | Kellner | 308/4 A |
| 4,076,084 | A | * | 2/1978 | Tighe | 175/61 |
| 4,080,010 | A | | 3/1978 | Young | 308/4 A |
| 4,101,179 | A | | 7/1978 | Barron | 308/4 A |
| 4,102,552 | A | * | 7/1978 | Kellner | 175/325.3 |
| 4,394,881 | A | * | 7/1983 | Shirley | 166/319 |
| 4,560,013 | A | | 12/1985 | Beimgraben | 175/73 |
| 4,580,642 | A | | 4/1986 | Gosch | 175/57 |
| 4,600,063 | A | | 7/1986 | Beasley | 175/325 |
| 4,606,417 | A | | 8/1986 | Webb et al. | 175/76 |
| 4,610,307 | A | | 9/1986 | Jürgens et al. | 175/320 |
| 4,630,690 | A | | 12/1986 | Beasley et al. | 175/57 |
| 4,630,694 | A | | 12/1986 | Walton et al. | 175/391 |
| 4,635,736 | A | | 1/1987 | Shirley | 175/76 |
| 4,635,738 | A | | 1/1987 | Schillinger et al. | 175/398 |
| 4,638,873 | A | * | 1/1987 | Welborn | 175/325.2 |
| 4,683,956 | A | | 8/1987 | Russell | 166/383 |
| 4,693,328 | A | | 9/1987 | Furse et al. | 175/273 |
| 4,698,794 | A | | 10/1987 | Kruger et al. | 367/83 |
| 4,729,438 | A | | 3/1988 | Walker et al. | 175/76 |
| 4,739,842 | A | | 4/1988 | Kruger et al. | 175/61 |
| 4,807,708 | A | | 2/1989 | Forrest et al. | 175/45 |
| 4,814,609 | A | | 3/1989 | Wraight et al. | 250/254 |
| 4,817,740 | A | | 4/1989 | Belmgraben | 175/74 |
| 4,854,403 | A | | 8/1989 | Ostertag et al. | 175/325 |
| 4,879,463 | A | | 11/1989 | Wraight et al. | 250/270 |
| 4,984,633 | A | | 1/1991 | Langer et al. | 166/241 |
| 4,989,679 | A | | 2/1991 | Amaudric du Chaffaut | 175/325 |
| 5,038,872 | A | | 8/1991 | Shirley | 175/76 |
| 5,050,692 | A | | 9/1991 | Beimgraben | 175/61 |
| 5,060,736 | A | | 10/1991 | Neff | 175/74 |
| 5,094,304 | A | | 3/1992 | Briggs | 175/61 |
| 5,099,931 | A | | 3/1992 | Krueger et al. | 175/75 |
| 5,150,757 | A | | 9/1992 | Nunley | 175/323 |
| 5,180,021 | A | | 1/1993 | Champion et al. | 175/76 |
| 5,200,705 | A | | 4/1993 | Clark et al. | 324/338 |
| 5,213,168 | A | | 5/1993 | Warren et al. | 175/61 |
| 5,222,565 | A | | 6/1993 | Collinsworth | 175/320 |
| 5,235,285 | A | | 8/1993 | Clark et al. | 324/342 |
| 5,242,020 | A | | 9/1993 | Cobern | 166/250 |
| 5,250,806 | A | * | 10/1993 | Rhein-Knudsen et al. | 250/254 |
| 5,265,684 | A | | 11/1993 | Rosenhauch | 175/61 |
| 5,293,945 | A | | 3/1994 | Rosenhauch et al. | 175/325.2 |
| 5,307,885 | A | | 5/1994 | Kuwana et al. | 175/26 |
| 5,317,111 | A | * | 5/1994 | Orban et al. | 175/40 |
| 5,318,137 | A | * | 6/1994 | Johnson et al. | 175/325.2 |
| 5,363,931 | A | | 11/1994 | Moriarty | 175/325.5 |
| 5,368,114 | A | | 11/1994 | Tandberg et al. | 175/267 |
| 5,437,342 | A | | 8/1995 | Powada | 175/325.5 |
| 5,465,759 | A | | 11/1995 | Carlson et al. | 138/110 |
| 5,474,143 | A | | 12/1995 | Majkovic | 175/323 |
| 5,495,899 | A | | 3/1996 | Pastusek et al. | 175/57 |
| 5,497,842 | A | | 3/1996 | Pastusek et al. | 175/334 |
| 5,511,627 | A | | 4/1996 | Anderson | 175/73 |
| 5,522,467 | A | | 6/1996 | Stevens et al. | 175/73 |
| 5,542,454 | A | | 8/1996 | Carlson et al. | 138/110 |
| 5,603,386 | A | | 2/1997 | Webster | 175/76 |
| 5,667,027 | A | * | 9/1997 | Poffenroth | 175/325.3 |
| 5,678,644 | A | | 10/1997 | Fielder | 175/391 |
| 5,765,653 | A | | 6/1998 | Doster et al. | 175/75 |
| 5,941,321 | A | * | 8/1999 | Hughes | 175/325.1 |
| 5,957,223 | A | | 9/1999 | Doster et al. | 175/57 |
| 6,116,356 | A | | 9/2000 | Doster et al. | 175/75 |
| 6,173,793 | B1 | | 1/2001 | Thompson et al. | 175/45 |
| 6,179,066 | B1 | | 1/2001 | Nasr et al. | 175/45 |
| 6,213,226 | B1 | | 4/2001 | Eppink et al. | 175/61 |
| 6,227,312 | B1 | | 5/2001 | Eppink et al. | 175/57 |
| 6,247,542 | B1 | * | 6/2001 | Kruspe et al. | 166/66 |
| 6,290,003 | B1 | * | 9/2001 | Russell | 175/325.1 |

OTHER PUBLICATIONS

Csonka, G., et al., "Ream while drilling technology applied successfully offshore Australia," *SPE International*, Aug. 28–31, 1996, SPE 36990, 271–278.

Fielder, C.M., "Advances improve bi–center drill bits," *The American Oil & Gas Reporter*, Apr. 1995, 3 pages.

Le Blanc, L. (ed.), et al., "Reaming–while–drilling keys effort to reduce tripping of long drillstrings," *Offshore*, Apr. 1996, 30–32.

Myhre, K., et al., "Application of bicenter bits in well–deepening operations," *IADC/SPE*, Feb. 27–Mar. 2, 1990, IADC/SPE 19921, 131–137.

Rothe, J.R., et al., "Ream–while–drilling tool cuts costs of three Venezuelan wells," *Oil & Gas Journal*, Jan. 13, 1997, 33–40.

Sketchier, B.C., et al., "New bi–center technology proves effective in slim hole horizontal well," *SPC International*, Feb. 28–Mar. 2, 1995, SPE/IADC 29396, 559–567.

Warren, T.M., et al., "Simultaneous drilling and reaming with fixed blade reamers," *APE Annual Technical Conf. and Exhibition*, Oct. 22–25, 1995, 1–11.

Burkhardt, Transactions, Society of Automotive Engineers, "Fundamentals of Brake Design", Part II, pp 267–316, 1925.

Huck, Transactions, Society of Automotive Engineers, "Breaks for Heavy Vehicles", Part I, pp 443–465, 1926.

* cited by examiner

STABILIZER FOR USE IN A DRILL STRING

RELATED APPLICATION

This application is a continuation-in-part of U.S. application Ser. No. 09/532,725, filed Mar. 22, 2000, entitled DRILL BIT STABILIZER.

FIELD OF THE INVENTION

The current invention is directed to an improved stabilizer for use in a drill string, such as that used to drill a bore through an earthen formation.

BACKGROUND OF THE INVENTION

In underground drilling, such as gas, oil or geothermal drilling, a bore hole is drilled through a formation in the earth. Bore holes are formed by connecting a drill bit to sections of long pipe so as to form an assembly commonly referred to as a "drill string" that extends from the surface to the bottom of the bore. The drill bit is rotated so that it advances into the earth, thereby forming the bore. A high pressure drilling fluid, typically referred to as "drilling mud," is pumped down through the drill string to the drill bit so as to lubricate the drill bit and flushes cuttings from its path. The drilling mud then flows to the surface through the annular passage formed between the drill string and the surface of the bore. The distal end of a drill string, which includes the drill bit, is referred to as the "bottom hole assembly."

A substantial portion of the problems encountered during drilling result from instability in the drill bit and drill string, which places high stress on the drill bit and other components of the drill string. Consequently, drill strings traditionally incorporate one or more stabilizers, which are typically located proximate the drill collar. Such stabilizers typically have pads or blades spaced around their circumference that extend radially outward so as to contact the wall of the bore and, thereby, stabilize the drill string.

Drill bit instability problems are especially prevalent with drill strings employing eccentric drilling elements, such as bi-center drill bits employing a closely coupled pilot drill and a reaming wing, or bottom hole assemblies incorporating a reaming wing separated from the drill bit or without any drill bit. A bottom hole assembly employing an eccentric drilling element can pass through a hole that is smaller than the hole formed by the drilling element. Eccentric drill bits are frequently used to enlarge, or drill an initially large, diameter section of a bore hole that is below a casing having an inside diameter less than that of the hole to be bored. Consequently, conventional stabilizers sized to provide full gauge stabilization—that is, stabilizers in which the outside diameter of the stabilize is only slightly less than the insider diameter of the bore hole formed by the drill bit—cannot pass through the casing to reach the section to be drilled. As a consequence, full gauge stabilization near the bit cannot be obtained with conventional stabilizers. A lack of full gauge stabilization can result in poor directional control, smaller than expected bore diameter, and excessive stress on the drill bit and drill string.

An improved stabilizer having three axially spaced apart blades, two of which are rotatable, that permits full gauge stabilization of a bi-center drill bit is disclosed in U.S. application Ser. No. 09/532,725, filed Mar. 22, 2000, entitled Drill Bit Stabilizer, hereby incorporated by reference in its entirety. While the stabilizer disclosed in that prior application has many advantages, further improvement in rotatable blade stabilizers, discussed below, are desirable. Consequently, it would be desirable to develop an improved stabilizer that had one or more rotatable blades so as to facilitate stabilization of drill strings employing eccentric drilling elements.

Traditionally, information concerning the properties of the formation being drilled through, such as its density, porosity, electrical resistivity/conductivity, etc., was obtained by a "wire line" technique. The technique involved removing the drill string from the bore hole and lowering a device, such as a sonde, which was attached to a cable, into the bore hole. The device typically contained various types of sensors, which may include gamma scintillators, resistivity sensors, nuclear detectors, etc., capable of sensing information concerning the formation. Resistivity sensors, for example, may be used to transmit, and then receive, high frequency wavelength signals (e.g., electromagnetic waves) that travel through the formation surrounding the sensor. By comparing the transmitted and received signals, information can be determined concerning the nature of the formation through which the signal traveled, such as whether it contains water or hydrocarbons. In some applications, the wire line device featured resistivity probes on independently articulated pads mounted on spring actuated arms to ensure that the sensors contacted the bore hole wall.

More recently, "logging while drilling" (LWD) systems have been developed in which the sensors are incorporated into the drill string so as to provide real-time information to the drilling operator concerning the properties of the formation being drilled through. In such systems, the information obtained by the sensor is transmitted to the surface, using techniques well known in the art such as mud pulse telemetry, where it is analyzed.

In many types of sensors, it is important that the sensor be as close as possible, and preferably in contact with, the formation so as to minimize errors in the measurement. Consequently, in the past, sensors in LWD systems have sometimes been mounted on the blades of stabilizers used to stabilize the drill string. Unfortunately, such approaches have not been entirely successful in ensuring that the sensor is maintained very close to, or in contact with, the formation. Consequently, it would also be desirable to provide an improved stabilizer that incorporated one or more sensors in such a manner as to ensure that the sensor is maintained very close to, or in contact with, the formation.

SUMMARY OF THE INVENTION

It is an object of the current invention to provide an improved apparatus for drilling a bore hole. This and other objects is accomplished in a stabilizer for use in a drill string for drilling a bore hole, comprising (i) a stabilizer body adapted to be mounted in the drill string, (ii) a first stabilizer blade affixed to the stabilizer body, the first stabilizer blade having a distal end adapted to engage the bore hole, (iii) a sleeve rotatably mounted on the stabilizer body, and (iv) at least a pair of circumferentially displaced second stabilizer blades projecting radially outward from the sleeve, the pair of second stabilizer blades rotating in a common circumferentially extending plane axially displaced from the first stabilizer blade.

In a preferred embodiment, the invention further comprises (i) a locking member locking the sleeve into a first position, (ii) means for applying a pressure to the locking member for unlocking the locking member in response to the pressure of the drilling fluid, whereby the sleeve can move into the second position when unlocked, and (iii)

means for intensifying the pressure applied to the locking member, whereby the pressure applied to the locking member is greater than the pressure of the drilling fluid. In another preferred embodiment, the stabilizer comprises a sensor for sensing whether or not the stabilizer blade is in a first position. In another preferred embodiment, the stabilizer has a pad mounted in the distal end of the stabilizer blade, the pad having first and second ends, a pivot joint pivotally coupling the pad first end to the blade distal end, whereby rotation of the pad about the pivot joint in a first direction displaces the pad second end radially outward so as to contact the bore hole wall.

The invention also encompasses a method of further drilling a bore hole through an earthen formation, comprising the steps of (i) inserting a drilling string having a stabilizer and an eccentric drilling element into the bore hole, the stabilizer having a rotatable stabilizer blade locked into a first circumferential orientation in which the blade is substantially aligned with the eccentric drilling element, (ii) unlocking the stabilizer blade, and (iii) rotating the unlocked stabilizer blade into a second orientation in which the blade is circumferentially displaced from the eccentric drilling element.

The invention also comprises an apparatus for use in a drill string for sensing a property of an earthen formation through which the drill string drills a bore hole when the drill string is rotated in a first circumferential direction, the bore hole having a wall, comprising (i) a housing adapted to be mounted in a drill string, (ii) a blade extending radially outward from the housing, the blade having a distal end, (iii) a sensor pad mounted in the distal end of the blade, the sensor pad having a circumferentially trailing first end and a circumferentially leading second end when the housing is rotated in the clockwise direction, a pivot joint pivotally coupling the first end of the sensor pad to the blade distal end whereby rotation of the sensor pad about the pivot joint in a counterclockwise direction displaces the sensor pad second end radially outward so as to contact and apply a force to the bore hole wall, the contact creating a friction force when the housing rotates in the clockwise direction that tends to further rotate the sensor pad about the pivot joint in the counterclockwise direction thereby increasing the force applied by the sensor pad second end to the bore hole wall, (iv) at least a first sensor mounted in the sensor pad for sensing a property of the formation.

DESCRIPTION OF THE PREFERRED EMBODIMENTS

Figure 1:
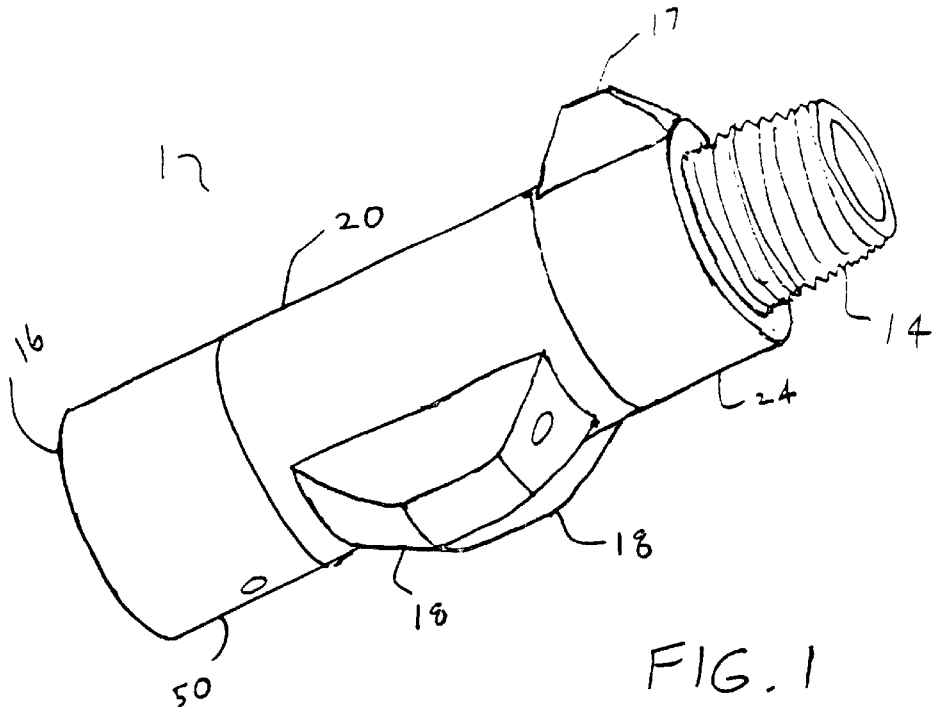
FIG. 1 is an isometric view of a stabilizer according to the current invention.
Figure 2:
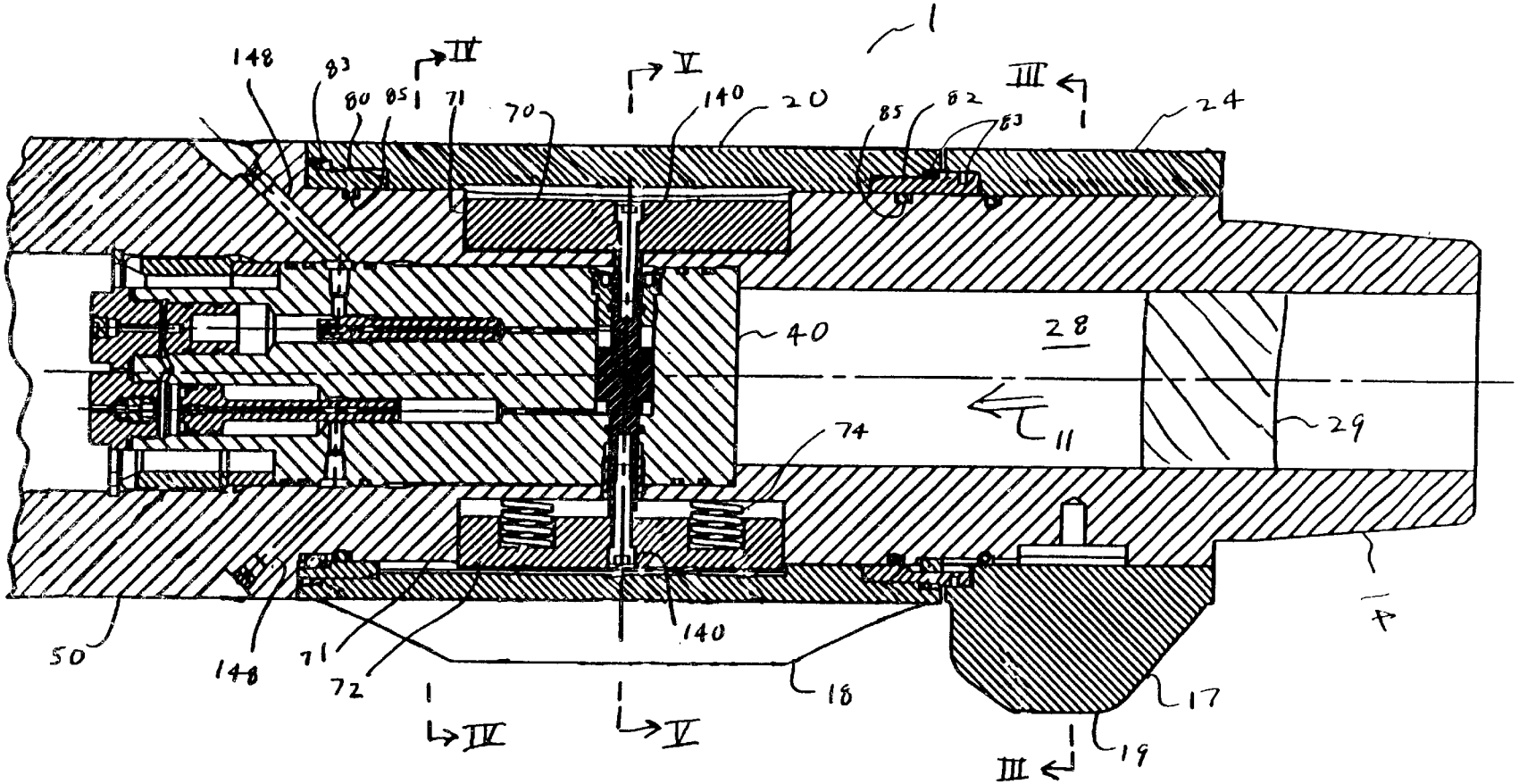
FIG. 2 is a longitudinal cross-section through the stabilizer shown in FIG. 1.

A stabilizer 1 according to the current invention is generally shown in FIGS. 1 and 2. Additional details of the stabilizer 1 are shown in FIGS. 3–19. The stabilizer comprises a body 50 that supports two sleeves—a rotatable sleeve 20 and a stationary sleeve 24. (Except when the drill bit rotated by a motor located below the stabilizer, such as in steerable drill strings, the stabilizer 1 rotates along with the drill bit and is not stationary during normal drilling. Thus, as used herein the term "stationary" refers to the lack of rotation relative to the body 50 of the stabilizer, without regard to whether there is rotation relative to the formation.) As shown best in FIG. 3, the stationary sleeve 24 is affixed to the body 50 by means of retaining keys 76 that extend through openings in the sleeve and engage recesses 79 in the body so as to prevent rotation of the sleeve 25 about the body. The retaining keys 76 are secured to the body 50 by screws 78. As shown in FIG. 2, the rotatable sleeve 20 is supported on brass bearings 80 and 82 secured to the body 50. The bearings 80 and 82 are located in grooves 81 formed in the inside diameter of the sleeve 20 at each of its ends, as shown in FIG. 8.

Figure 12A:
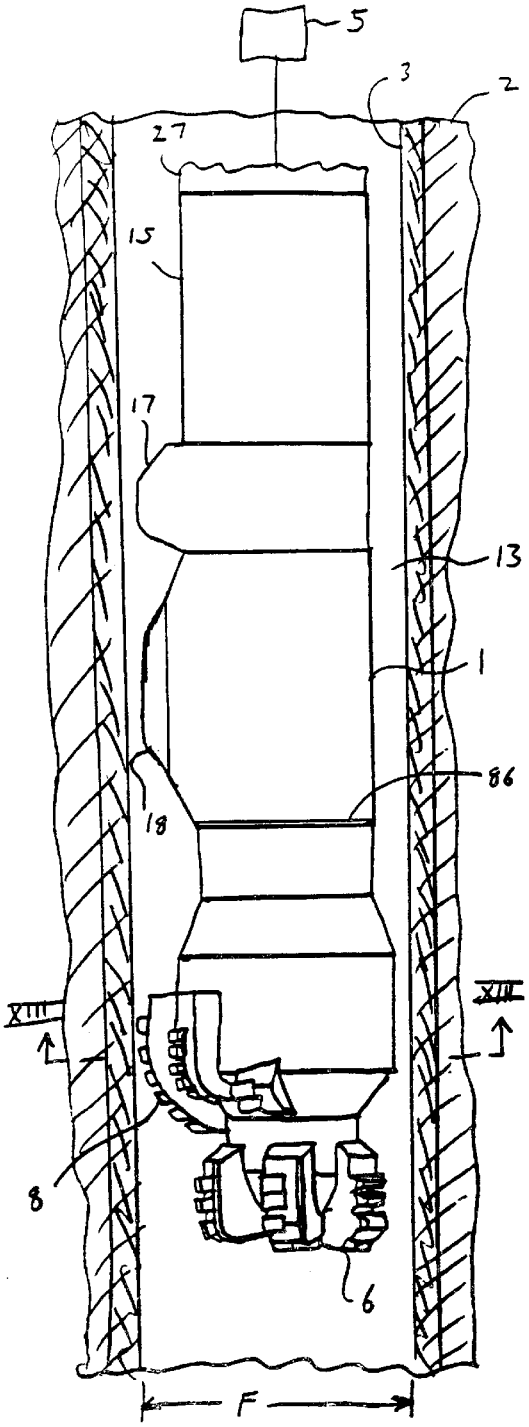
FIGS. 12(*a*) and (*b*) show the stabilizer according to the current invention assembled in a drill string employing a bi-centered drill bit (a) while the drill string is being tripped into the hole with the rotatable blades aligned with the stationary blade in the inactive orientation, and (b) with the drill bit in operation and the rotatable blades rotated into the active orientation so as to effect stabilization.
Figure 12B:
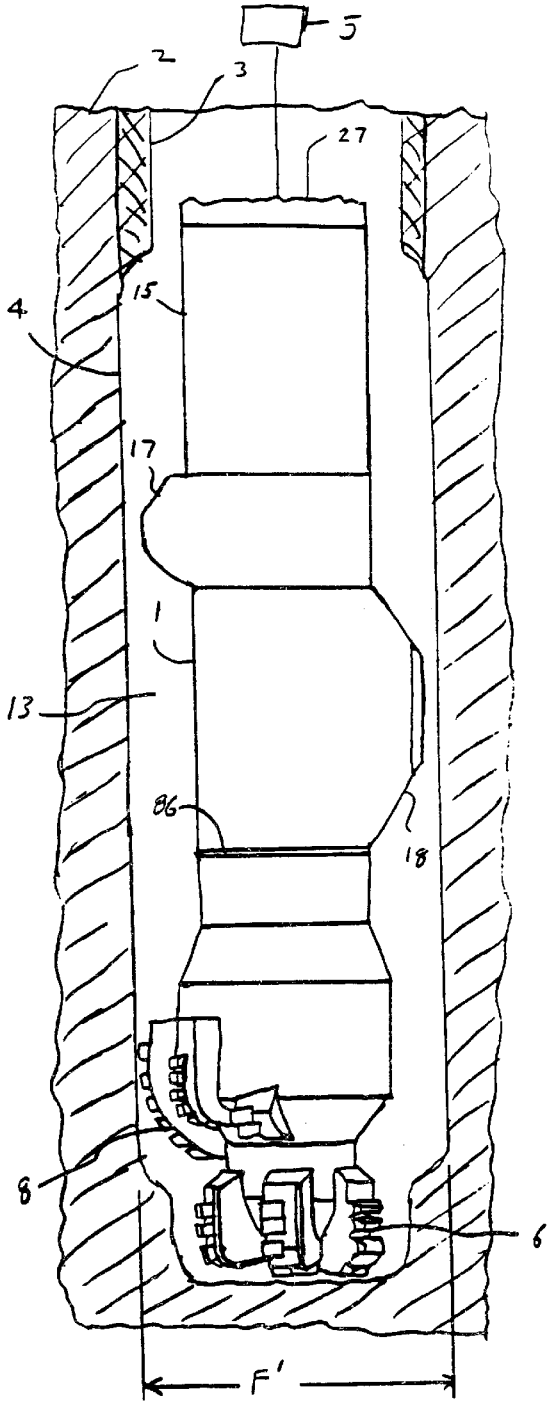

FIGS. 12(*a*) and (*b*) show the stabilizer 1 incorporated into a drill string 27 that includes a pilot bit 6, a reaming wing 8, and an element 15 that, depending on the application, may be a drill collar or a motor. The drill string 27 is rotated by a conventional drive mechanism 5 (which rotates the drill string in the clockwise direction, looking in the down hole direction, to effect drilling), such as a motor, that is mounted at the surface. Couplings 14 and 16 are formed on opposite ends of the stabilizer body 50. Coupling 14 consists of male pipe threads that allow the stabilizer to be threaded into a section of the drill string, such as element 15. Coupling 16 consists of female pipe threads, formed in the wall of the central passage 28 of the stabilizer body 50, that allow the stabilizer 1 to be threaded onto the drill bit. Although as shown in FIG. 12, the stabilizer 1 is coupled directly to the drill bit, the stabilizer could also be incorporated at other locations in the drill string, such as above the element 15 so that, for example, a down hole motor used for directional steering was located between the stabilizer and the drill bit.

Figure 3:
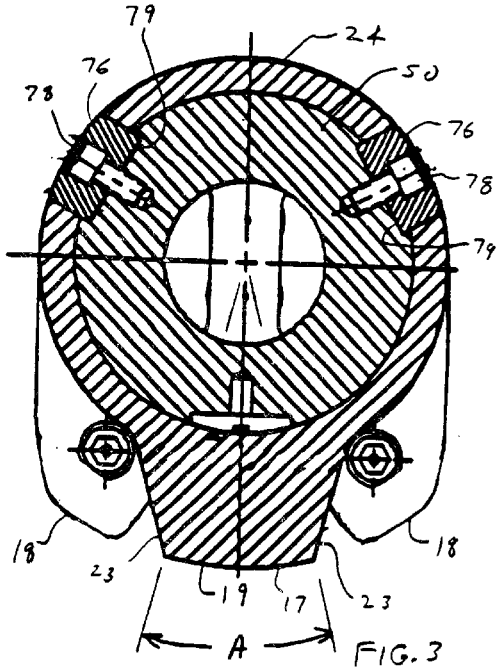
FIG. 3 is a transverse cross-section taken along line III—III shown in FIG. 2, showing the stationary blade.

As shown in FIGS. 2 and 3, a blade 17 projects radially outward from the stationary sleeve 24. The distal end of the blade 17 has an arcuate surface 19 that is adapted to contact the walls of the bore so as to aid in stabilization. The relatively wide shape of the blade 17 and the fact that it is integrally formed with the sleeve 24 provides a rugged construction. Preferably, the blade contact surface 19 encompasses an angle A, shown in FIG. 3, of at least about 30°. The included angle between the sides 23 of the stationary blade is preferably about 30°.

Rotatable Stabilizing Blades

Figure 9:
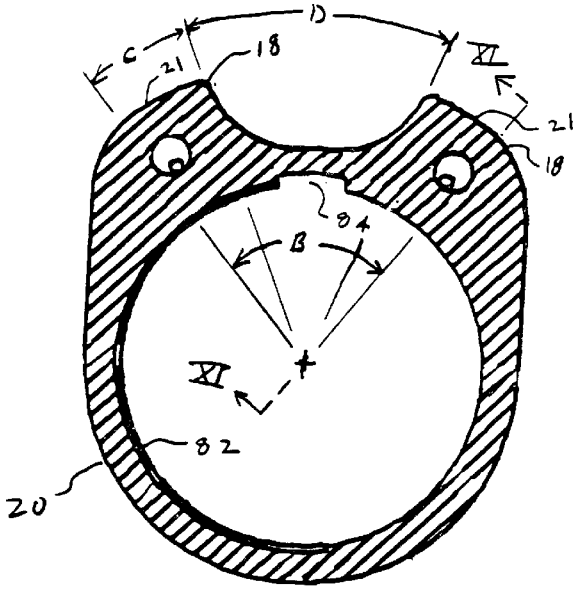
FIG. 9 is a transverse-cross section through the rotatable sleeve taken along line IX—IX shown in FIG. 8.

As shown in FIG. 9, two blades 18, lying in the same circumferential plane and circumferentially spaced apart, project radially outward from the rotatable sleeve 20. The rotatable blades 18 are axially displaced, preferably in the down hole direction, from the stationary blade 17. Rotation of the rotatable sleeve 20 causes the rotatable blades 18 to rotate in a common plane, which is perpendicular to the stabilizer longitudinal axis, about the stabilizer body 50.

Each rotatable blade 18 has an arcuate surface 21 adapted to contact the walls of the bore so as to provide further stabilization. Like the stationary blade 17, the rotatable blades are integrally formed with the sleeve and of rugged construction. Preferably, each of the blade contact surfaces 21 encompasses an angle C of at least about 15°. In general, the larger the contact surface, the more effective the stabilization. However, employing too large a contact surface 21 will result in excessive frictional resistance to rotation when the blades 18 scrape against the wall of the bore hole. Although two blades are preferable, the invention could also be practiced using a stabilizer with a single, rotatable blade, as disclosed in aforementioned U.S. application Ser. No. 09/532,725, or with more than two blades rotatable blades.

Figure 16:
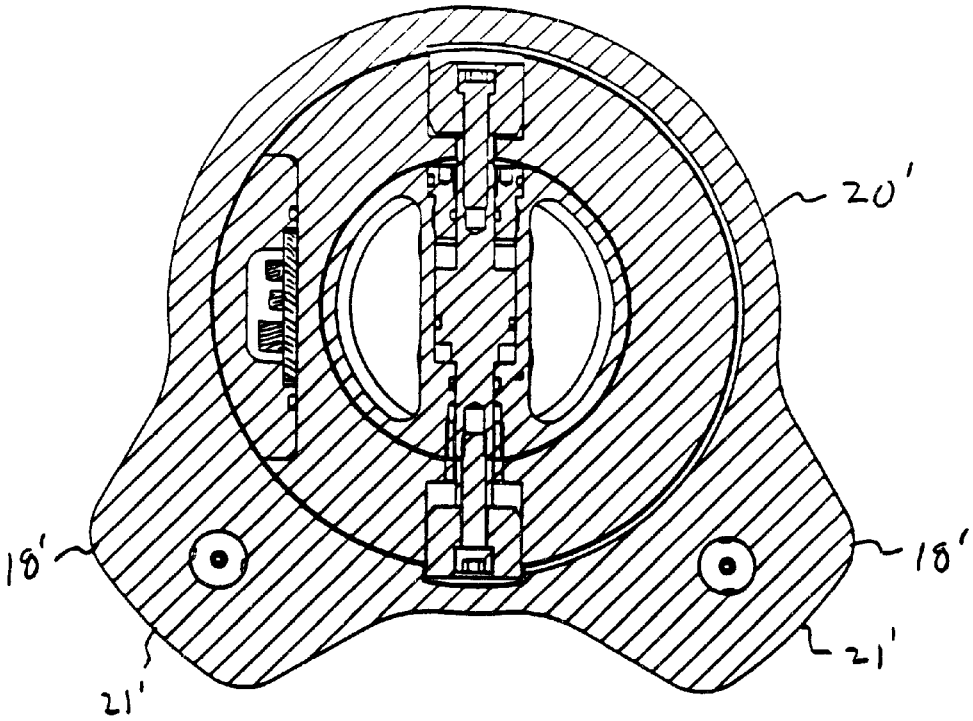
FIG. 16 is an alternative embodiment of the rotatable sleeve shown in FIG. 5.

In one embodiment, the angle D between the inner edges contact surfaces 21, shown in FIG. 9, is about 40° so that the total angle B spanned by the outer edges of the contact surfaces 21 of the rotatable blades 18 is about 70°. Employing two blades 18, rather than a single blade spanning angle B, achieves effective stabilization but reduces the drag created by the stabilizer as it scraps against the walls of the bore hole and reduces the resistance the blades 18 impose on the flow of drilling mud through the annulus 13 between the drill string and the bore hole, shown in FIG. 12. Of course, as discussed below, the configuration of each stabilizer should be optimized according to the geometry of the eccentric drilling element with which it will be used. An alternate embodiment of the rotatable sleeve 20', having somewhat differently shaped rotatable blades 18', is shown in FIG. 16.

Figure 13:
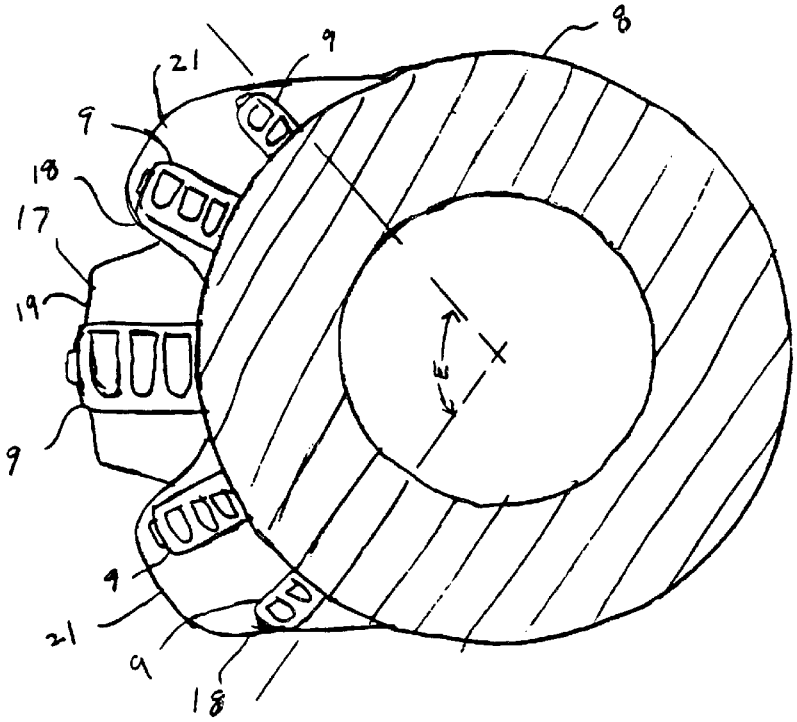
FIG. 13 is a transverse cross-section taken along line XIII—XIII shown in FIG. 12(*a*), showing the positioning of the stationary and rotatable blades relative to the reaming wings of the bi-center bit.

As shown in FIG. 13, the reaming wing 8 comprises an eccentric drilling element consisting of five sets of circumferentially offset teeth 9 extending radially outward. As shown in FIGS. 12(*a*) and 13, the stabilizer is circumferentially oriented with respect to the drill bit and the stationary sleeve 24 is circumferentially oriented on the stabilizer body 50 so that, when the stabilizer 1 is mounted on the drill bit, the stationary blade 17 is axially aligned with the center of the teeth 9 of the reaming wing 8. Further, as also shown in FIG. 13, when the bottom hole assembly is tripped in the casing 3, the rotatable sleeve 20 is circumferentially oriented on the stabilizer body 50 so that the rotatable blades 18 are also axially aligned with the reaming wing 8. Preferably, the angle B spanned by the contact surfaces 21 of the rotatable blades 18, shown in FIG. 9, falls within the angle E spanned by the teeth 9 of the reaming wing 8, as shown in FIG. 13.

Preferably, the radial distance by which the contact surfaces 19 and 21 of the stationary and rotatable blades 17 and 18, respectively, are displaced from the centerline of the stabilizer body 50 is slightly less than the distance by which the teeth 9 of the reaming wing 12 are displaced from the centerline of the drill bit so that the contact surfaces of the wings do not extend radially outward further than the reaming wing teeth 9. In addition, the stabilized body 50, drill collar 15, and other components of the bottom hole assembly must be sized so as not to extend beyond the profile of the reaming wing 8. This allows the stabilizer 1 to be tripped into the casing behind the reaming wing 8 without interference by the blades, or other components of the bottom hole assembly, yet provides good stabilization. Consequently, as shown in FIG. 12(*a*), when the rotatable blades 18 are aligned with the reaming wing 8, as shown in FIG. 13, the drill bit/stabilizer assembly can be lowered into a casing 3 of diameter F that is less than the diameter F' of the bore 4 formed by the reaming wing 8—that is, less than twice the maximum radius of the reaming wing teeth 9. For example, the diameter F of the casing 3 might be about 12¼ inches, whereas the diameter F' of the bore hole 4 might be about 14½ inches.

Once the reaming wing 8 and stabilizer 1 have passed beyond the casing 3 and drilling is ready to begin, as shown in FIG. 12(*b*), the sleeve 20 is rotated 180° on the stabilizer body 50, using the technique discussed below, into the angular orientation shown in FIG. 4(*b*), so that the midpoint between the rotatable blades 18 is located 180° from the center of the stationary blade. In this position, the stabilizer provides essentially three-point, full gauge stabilization of the drill bit in the bore 4 of diameter F' formed by the reaming wing 8. Moreover, by employing a pair of rotatable blades 18 that are located in the same circumferential plane, the overall length and weight of the stabilizer 1 is reduced. Reducing the length of the stabilizer reduces the "bit-to-bend" distance—that is, the distance between the drill bit and the bottom hole assembly motor in a steerable drill string—which improves steering ability. In a preferred embodiment of the invention, the overall length of the stabilizer 1, excluding the coupling 14, is less than 30 inches.

Ideally, the blades of a conventional, three blade, fixed blade stabilizer would be spaced at 120° intervals. However, such a stabilizer could not achieve full gauge stabilization in a typical bi-center drill bit application because it could not pass through the casing 3. As shown in FIG. 4(*b*), preferably, the centers of the contact surfaces 21 of rotatable blades 18 are circumferentially displaced by an angle J that is at least about 60° so that the center of the contact surfaces 21 of the rotatable blades 18 are displaced from the center of the contact surface 19 of the stationary wing 17 by an angle G that is no more than about 150°, and preferably, no more than about 140°. Moreover, due to the circumferential expanse of the contact surfaces, the edge of each of the rotatable blade contact surfaces 21 is displaced by an angle H that is preferably no more than about 130° from the edge of the stationary blade contact surface 19. This configuration allows the stabilizer 1 to provide essentially the same degree of stabilization provided by a conventional, fixed blade stabilizer having three equally spaced blades. In general, the greater the circumferential expanse of the contact areas 21 and the further apart the contact areas—that is, the larger the angle B shown in FIG. 9 —the more effective the stabilization but the larger the pass through diameter and the greater the blockage of the flow of drilling mud through the annulus 13 between the drill string and the bore hole. In an alternate embodiment shown in FIG. 16, the center of the contact surfaces 21' of the rotatable blades 18' are circumferentially displaced by an angle of about 90° so that the center of each of the contact surfaces 21' is circumferentially displaced from the center of the stationary blade by an angle of 135°.

Preferably, shims 86 are installed between the stabilizer 1 and the drill bit, as necessary, to ensure that the stationary blade 17 is axially aligned with the reaming wing 8. Alternatively, the threads in the coupling 16 can be specially machined relative to the threads on the drill bit so that the proper alignment is obtained when the two components are fully threaded together. Moreover, the threaded coupling 16 could be dispensed with and the stabilizer welded to, or integrally machined with, the drill bit so that the stabilizer 1 and reaming wing formed a unitary assembly, with the stationary blade permanently aligned with the reaming wing 8. Such a unitary assembly would avoid the need to align the stabilizer to the drill bit at the drilling site and would result in a more compact, shorter assembly.

Seals 83 and 85 are incorporated between the bearings 80 and 82 and the stabilizer body 50, and between the bearings and the sleeve 20, to prevent leakage of drilling mud into the radial clearance gap between the rotatable sleeve 20 and the stabilizer body 50. Preferably, the clearance gap is filled with oil to facilitate rotation of the sleeve and, when pressurized as discussed below, prevent ingress of drilling mud.

Figure 11:
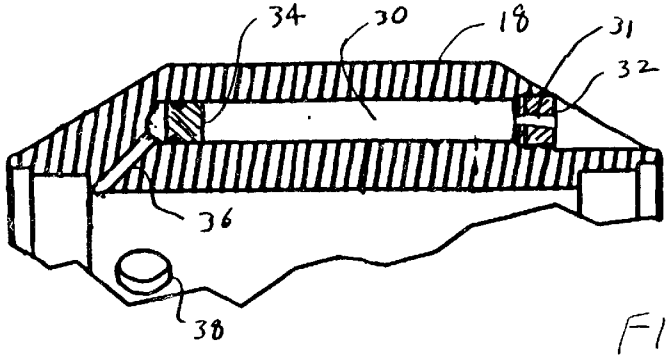
FIG. 11 is cross-section taken along line XI—XI shown in FIG. 9, showing the pressure equalization components for the rotating sleeve seals.

In a preferred embodiment of invention, a pressure compensation system is incorporated into the sleeve 20, as shown in FIG. 11. An approximately axially extending passage 30 is formed in each of the rotatable blades 18. The inlet of this passage 30 is closed by a cap 32 through which a small hole 31 extends. A smaller passage 35 extends radially inward from the outlet of passage 30 to the inner surface of the sleeve 20 just behind the bearing 80 so as to communicate with the oil-filled clearance gap. A piston 34 slides within the passage 30. Preferably, the passage 30 is filled with a grease. When the stabilizer is lowered into the bore 4, drilling mud enters the hole 32 and applies pressure to the grease in the passage 32. This causes displacement of the piston 34 so as to pressurize the oil in the passage 36, and the clearance gap with which it communicates, to approximately the same pressure as that of the drilling mud in the annular passage 13 between the drill string and the bore 4. This pressurization of the oil in the clearance gap ensures that drilling mud will not leak pass the seals 83 and 85 into the clearance gap.

Rotatable Blade Actuation Mechanism

Figure 5:
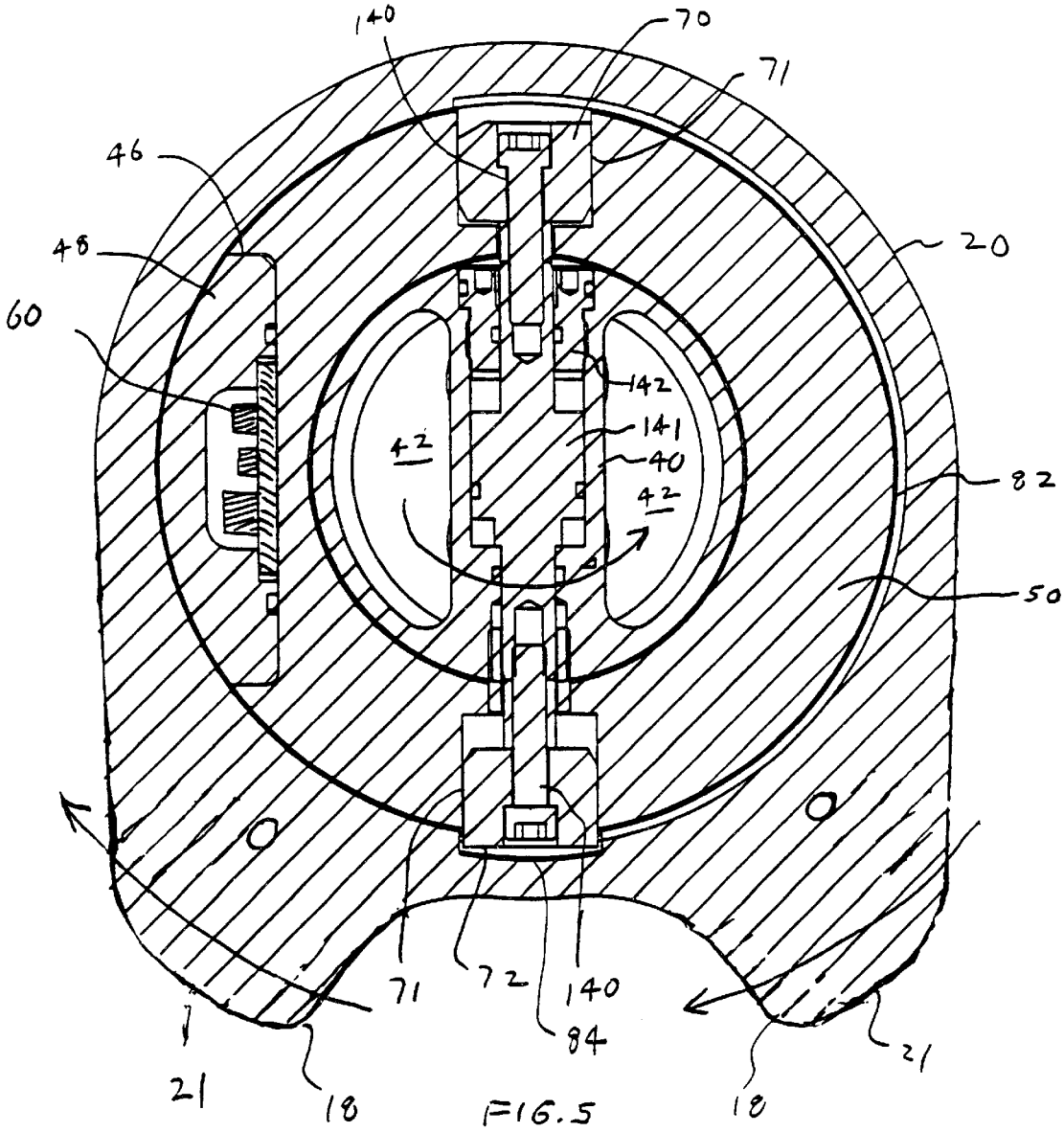
FIG. 5 is a transverse cross-section taken along line V—V shown in FIG. 2.

Actuation of the rotatable sleeve 20 will now be discussed. As shown in FIG. 5, when the rotatable blades 18 are in the inactive position—that is, aligned on either side of the stationary blade 17 so that the midpoint between them coincides with the center of the stationary blade—a pin 72 mounted in a hole 71 in the stabilizer body 50 engages a recess 84 formed in the inside surface of the rotatable sleeve 20 that is located midway between the rotatable blades. Springs 74, shown in FIGS. 2 and 7, urge the pin 72 radially outward into engagement with the recess 84. Thus, as shown in FIG. 5, the rotatable sleeve 20 is locked in the inactive position. The pin 72 is attached by a connector 140 to one end of a piston 141 that slides within a piston housing 40 mounted within the stabilizer body 50. A second pin 70 is attached by another connector 140 to the other end of the piston 141. Although helical compression springs 74 are shown, other elements capable of biasing the pin 72 radially outward could also be employed, such as belville springs and leaf springs.

After the stabilizer 1 has been tripped in the bore hole, the flow of drilling mud down through the drill string is initiated in preparation for drilling. As shown in FIG. 2, the drilling mud 11 flows through a central passage 28 formed in the stabilizer body 50 and then through the piston housing 40 by means of two passages 42, shown in FIG. 5. Although the flow of drilling mud 11 is used to actuate the rotation of the blades 18 into the active orientation, it is important that this actuation does not occur prematurely since it will often be necessary to initially drill out the casing shoe before the drill bit and stabilizer can clear the casing and the drilling of the formation begin. Until this initial drilling is completed, the stabilizer blades cannot be oriented into the active position because they remain located within the reduced diameter of the casing. Accordingly, as discussed below, a burst plate 108 or similar pressure actuated device is preferably employed to ensure that premature actuation of the rotatable blades 18 does not occur. Thus, during the drilling of the casing shoe, the flow of drilling mud is kept sufficiently low to avoid rupturing the burst plate and prematurely actuating the rotatable blades 18.

When the stabilizer has moved down clear of the casing 3 and the drilling of the formation is ready to begin, the flow rate of the drilling mud 11 is increased until it ruptures the burst plate 108 and imparts a force, as explained below, that displaces the piston 141 upward when viewed as shown in FIG. 5. This causes the pin 72 to retract so as to disengage from the recess 84, thereby rendering the sleeve 20 free to rotate about the stabilizer body 50. During rotation of the drill string, indicated by the counterclockwise arrow in FIG. 5 (which is viewed looking in the up hole direction), drag is imparted to the rotatable blades 18 as they rotate through the drilling mud and frictional resistance is imparted to the blade contact surfaces 21 as a result of contact with the walls of the bore hole. When the sleeve 20 is unlocked, these forces cause the rotatable sleeve 20 to rotate in the opposite direction (clockwise as viewed in FIG. 5) relative to the stabilizer body 50. A circumferential groove 82 extending part-way around the inside surface of the sleeve 20 facilitates the sliding of the distal end of the pin 70 around the inside surface of the sleeve. When the sleeve 20 has rotated approximately 180°, the pin 70 reaches the recess 84 and the force on the piston 141 seats the pin 70 into the recess so that the rotatable sleeve 20 is locked with the blades 18 in the active position, as shown in FIG. 4(*b*). Thus, when the piston 141 is in a first position (downward as shown in FIG. 5), the pin 72 is engaged in the recess 84 and the rotating blades 18 are locked in the inactive position, when the piston is in a second position (upward as viewed in FIG. 5), the pin 70 is engaged in recess 84 and the blades are locked in the active position, and when the piston is in an intermediate position, neither pin is engaged and the blades are free to rotate about the stabilizer body.

Figure 10:
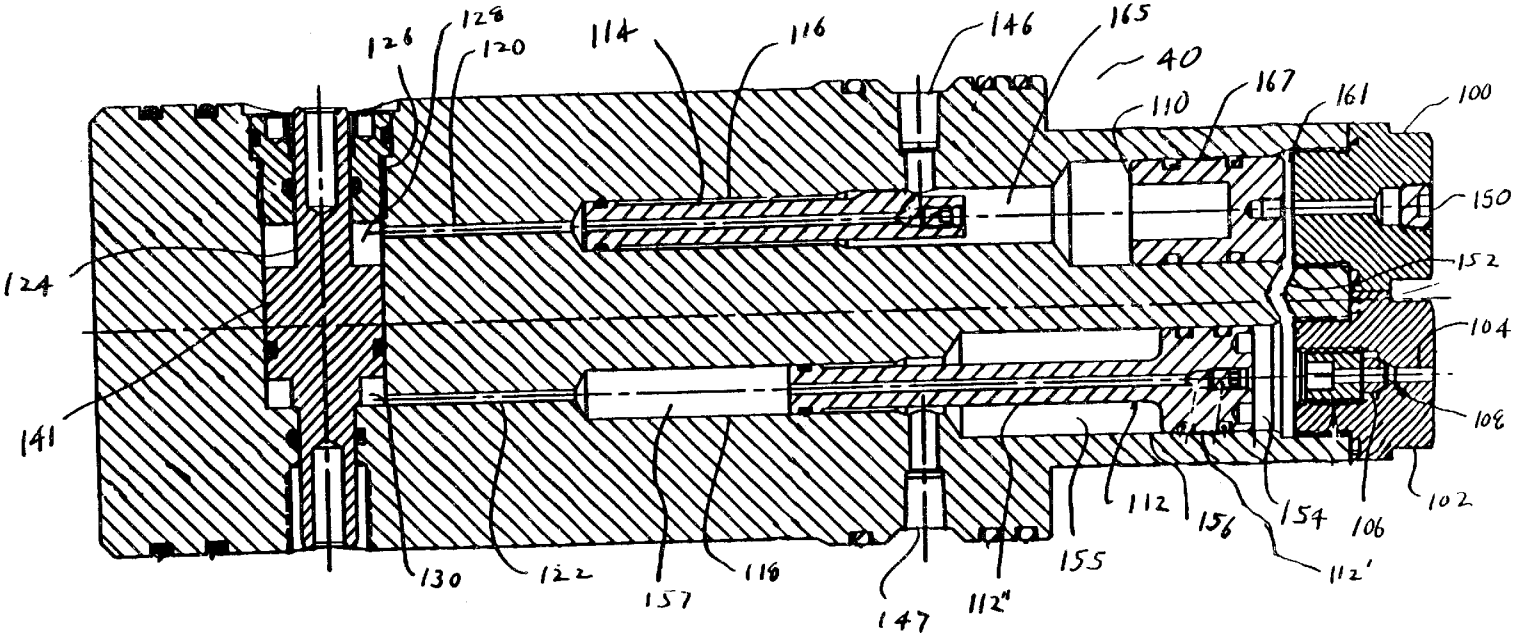
FIG. 10 is an enlarged view of the piston housing shown in FIG. 2.
Figure 18:
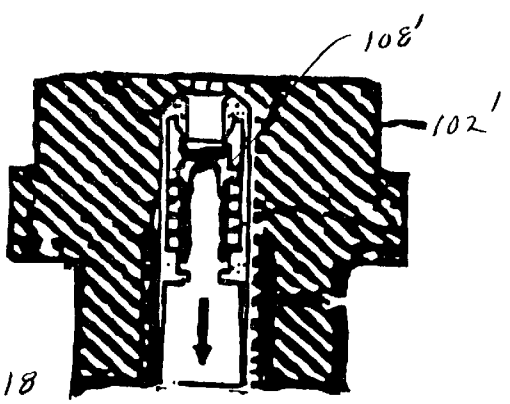
FIG. 18 is a detailed view of an alternate embodiment in which a spring-loaded pressure relief valve is used in place of the burst plate.
Figure 17:
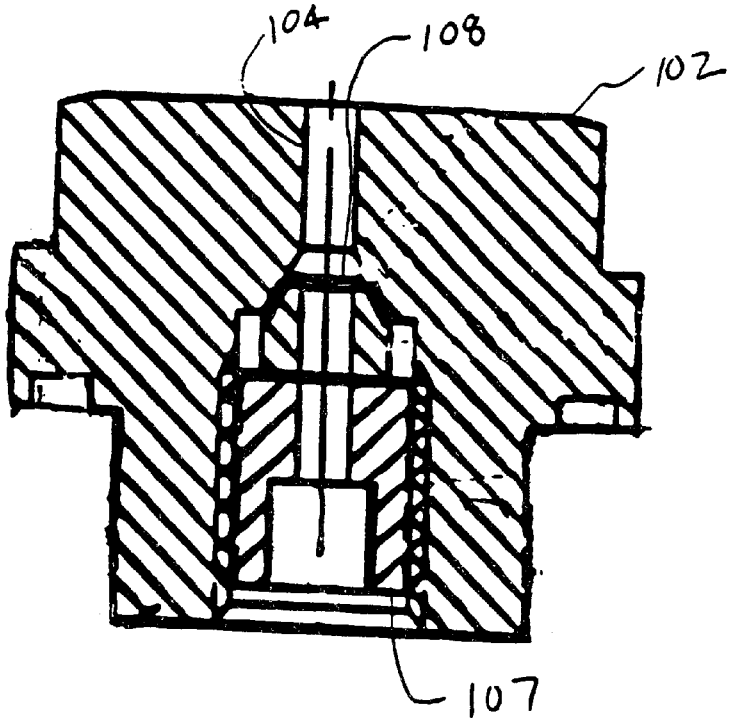
FIG. 17 is a detailed view of the burst plate assembly shown in FIG. 10.
Figure 19:
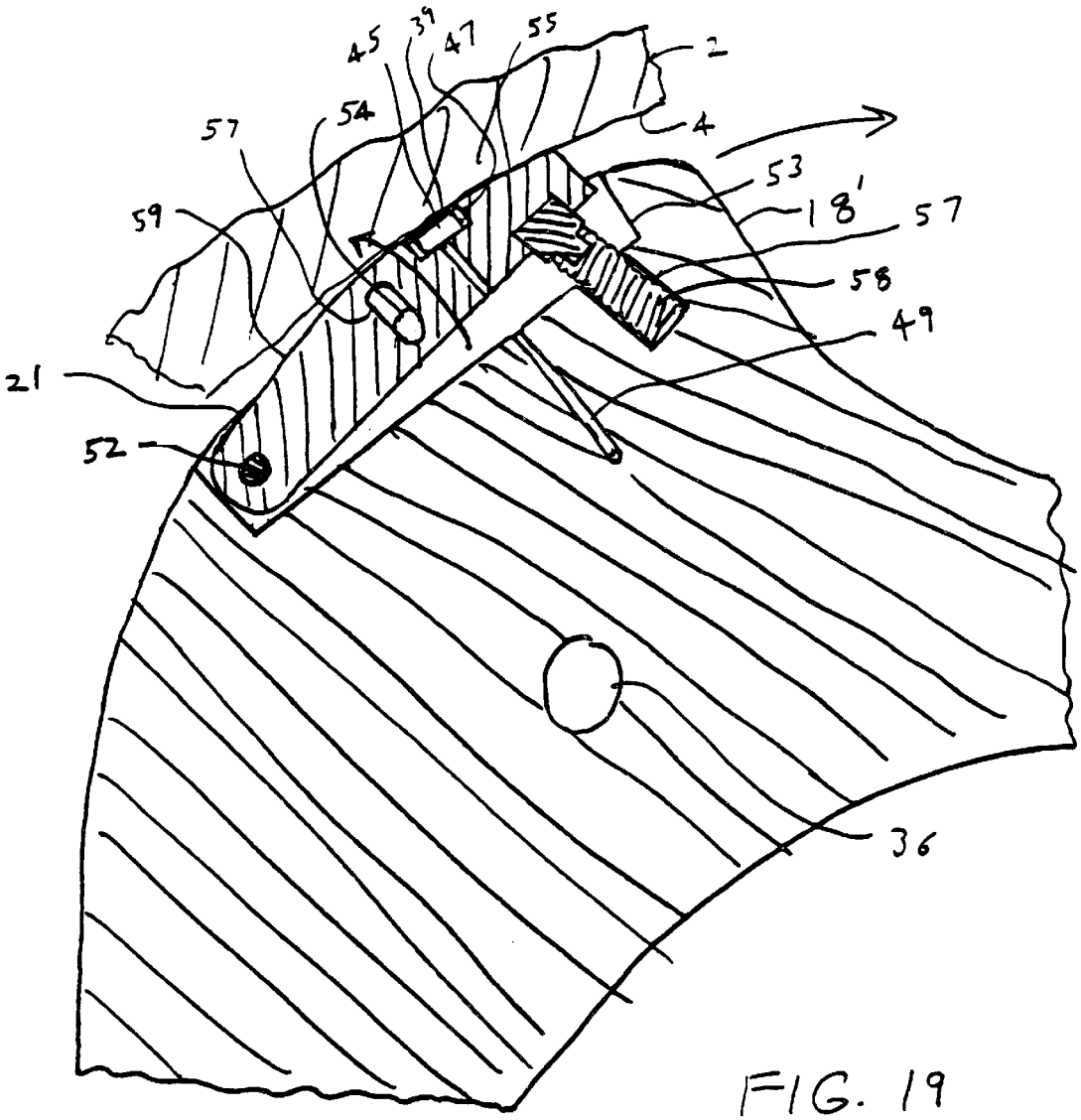
FIG. 19 is a detailed view of a transverse cross-section, looking in the down hole direction, through a portion of one of the rotatable blades of an alternative embodiment, showing the incorporation of a brake shoe and sensor.

The mechanism for imparting force to the piston 141 is shown in FIG. 10. A cap 102 is threaded into one end of the piston housing 40. A passage 104 in the cap 102 is in flow communication with the central passage 28 through the stabilizer body 50. A small burst plate 108, shown best in FIG. 17, is mounted within the hole 104 by a retainer 106. As previously discussed, the burst plate 108 ensures that the actuation of the rotatable blades 18 into the active orientation does not occur prematurely. The burst plate 108 is preferably a metal disk thinned and scribed so as to burst when a predetermined pressure differential is applied across the burst plate, which, in one embodiment of the invention, is about 800 psi. Alternatively, other devices known in the art that are designed to admit fluid when a predetermined pressure is reached, such as relief valves and blow-out valves, could also be utilized in place of the burst plate. FIG. 19 shows an alternate embodiment in which a spring loaded relief valve 108' is used in place of the burst plate.

During assembly of the stabilizer 1, the cavities 128 and 130 on either side of the piston 141, the small passages 120 and 122, the cavity 157 in passage 118, the cavities 155 and 154 in passage 156, the passage 152, and the cavity 161 in passage 167, are all filled with oil, after which the fill-passage through the pistons 114, 112 and 100 are plugged, for example, by plug 150 in the case of cap 100.

As the stabilizer 1 is lowered deeper into the bore hole, it becomes subjected to progressively greater hydrostatic pressure from the drilling mud in the hole. As a result of the weight of the drilling mud in the column above the stabilizer 1, this pressure may be as high as 20,000 psi. Consequently, the piston housing 40 incorporates a pressure equalization system for the burst plate 108 to prevent its premature rupture. Specifically, when the stabilizer is lowered into the bore hole, the drilling mud will enter the inlet of passage 104 and exert pressure on the outside surface of the burst plate 108. Drilling mud will also enter passages 148 in the stabilizer body 50, shown in FIG. 2. The passages 148 supply an annular passage that is in flow communication with passages 146 and 147 formed in the piston housing 40, as shown in FIG. 10. Since the cavity 165 formed in passage 116 is initially only air-filled, the mud will flow inward and exert a pressure that acts against the piston 110. The displacement of the piston 110 pressurizes the oil in cavity 161 and, as a result of the connecting passage 152, pressurizes the oil in cavity 154 as well. The oil in cavity 154 then exerts a pressure on the inside surface of the burst plate 108 that is essentially equal to the pressure on the burst plate outside surface, thereby equalizing the pressure across the burst plate.

The pressure equalization system is desirable because the pressure differential ultimately applied across the burst plate 108 when full mud flow is established may be relatively low—for example, only about 200 psi. Without the pressure equalization system, the burst plate 108 would have to be sized to withstand the 20,000 psi applied by the weight of the drilling mud. Since the burst pressure tolerance for burst plates is typically ±2%, it would be difficult to size a burst plate that did not rupture prematurely when the stabilizer was lowered into the bore hole yet reliably ruptured when the flow of drilling mud was established.

In any event, when the mud pumps are started and drilling mud begins to flow down through the central passage 28, the pressure of the drilling mud in the passage 28 becomes greater than the pressure of the drilling mud in flowing back up to the surface through the annulus 13 between the drill string and the bore hole, for example, due to the pressure drop associated with flowing through the drill bit. Consequently, the pressure of the drilling mud on the outside surface of the burst plate 108, which is exerted by the mud flowing through the central passage 28, becomes greater than the pressure on the inside surface of the burst plate, which is exerted by the mud flowing through the annulus 13 to the surface.

As the flow of mud is increased in preparation for beginning drilling through the formation, the pressure differential across the burst plate 108 becomes greater. Eventually, it will become sufficiently great to rupture the burst plate 108, causing the pressure of the mud in central passage 28 is exerted on the large end of piston 112. This pressure drives piston 112 to the left, as viewed in FIG. 10, which increases the pressure in cavity 130 and drives the piston 141 upward as viewed in FIG. 10 against the resistance of the compression springs 74. The displacement of the piston 141 drives the piston 114, which acts as a barrier between the oil in the actuation system and the drilling mud in cavity 165, to the right. Displacement of the piston 141 also disengages the pin 70 from the recess 84, thereby freeing the sleeve 20 to rotate. Once the sleeve 20 has rotated 180°, the pin 72 engages the recess 84 so that the rotatable blades 18 are locked in the active orientation shown in FIG. 4(*b*), as previously discussed.

When it is desired to withdraw the bottom hole assembly from the bore hole, the mud pumps are stopped, thereby eliminating the pressure differential opposing the springs 74. Consequently, the springs 74 drive piston 141 downward as viewed in FIG. 10. As a result of drag and contact with the bore hole, continued rotation of the stabilizer will again cause the sleeve 20 to rotate around the stabilizer body 50 another 180° until the pin 72 is again engaged in the recess 84, as shown in FIG. 5, thereby locking the rotatable blades in the inactive orientation, shown in FIGS. 4(*a*) and 5. A chamfer in the pin 70 allows the pin to be disengaged from the recess 84 by rotating the drill string in the reverse direction, counterclockwise as viewed in FIG. 5. This is a backup feature that ensures that the rotating blades can be oriented back into the inactive position in the event of a malfunction in the piston actuation mechanism.

Since the cross-sectional area of the smaller diameter portion 112" of the piston 112 is preferably only about one fifth that of the cross-sectional area of the larger diameter portion 112', the pressure of the oil in the cavity 157 that is applied to piston cavity 130 on one side of the piston 141 is about five times that the pressure of the drilling mud in central passage 28. For example, suppose that, after the flow of drilling mud was established, the pressure of the drilling mud in the annulus 13 was 20,000 psi and the pressure of the drilling mud in central passage 28 was 20,200 psi. A 200 psi pressure differential would be applied to the piston 112. This would then increase the pressure in piston cavity 130 from 20,000 psi to 21,000 psi, thereby intensifying the pressure force driving the actuation of the piston 141.

Intensification of the piston actuating pressure is useful since, in order to actuate the piston 141, this pressure must overcome the resistance of the springs 74 to compression. If the pressure were not intensified, a spring having a lower spring constant would be required, reducing the force used to reseat the pin 70 when the rotatable sleeve 20 has been oriented back into the inactive position prior to withdrawal of the bottom hole assembly. Thus, the piston actuation pressure intensification system ensures that sufficiently large spring forces can be used to ensure reliable locking of the rotatable blades 18 in the inactive orientation.

Mechanism for Sensing Circumferential Orientation of the Rotatable Blades

According to an important aspect of the invention, a system is incorporated into the stabilizer for detecting the angular orientation of the rotatable sleeve 20 with respect to the stabilizer body 50. Detection of the angular orientation can allow the drilling operator to determine that the rotatable sleeve 20 has assumed its active orientation prior to commencement of reaming. Perhaps more importantly, such detection can also allow the drill operator to confirm that the rotatable sleeve has been re-oriented into its inactive orientation.

Figure 6:
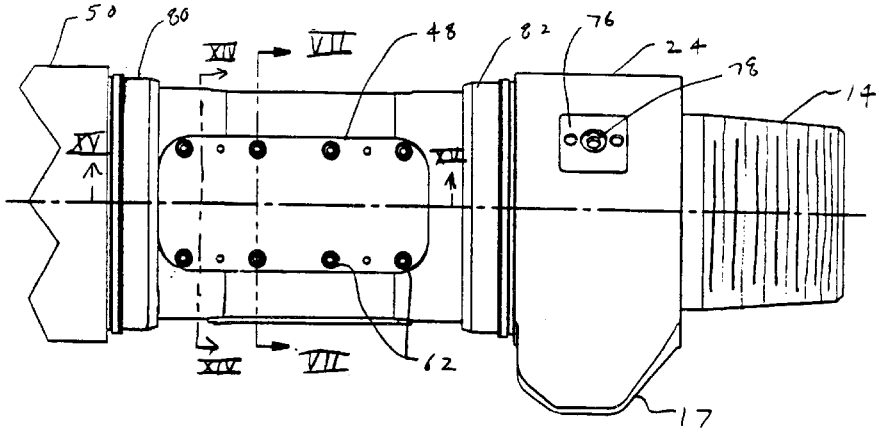
FIG. 6 is a view of the stabilizer shown in FIG. 2 with the rotatable blade assembly removed, showing the hatch for the electronics.
Figure 7:
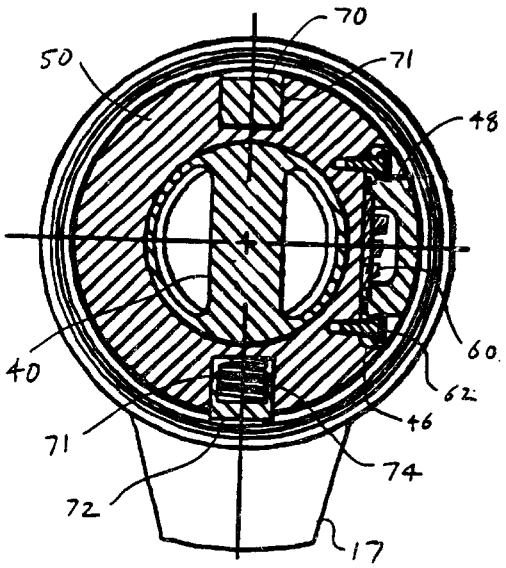
FIG. 7 is a transverse cross-section taken along line VII—VII shown in FIG. 6, showing the electronics package.
Figure 8:
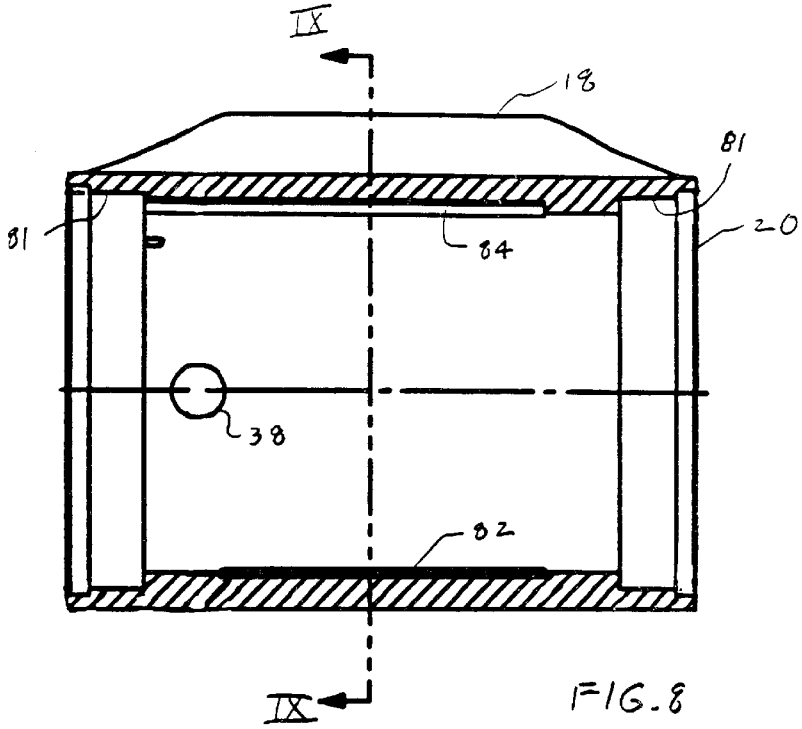
FIG. 8 is a longitudinal cross-section through the rotatable sleeve.
Figure 14:
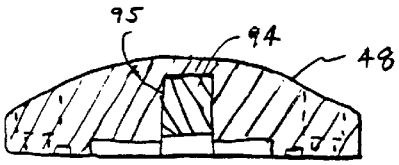
FIG. 14 is a transverse cross-section taken along line XIV—XIV shown in FIG. 6, showing the hatch and magnetic detector.
Figure 15:
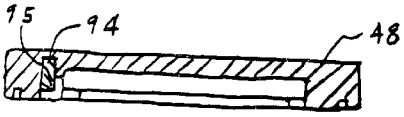
FIG. 15 is a longitudinal cross-section taken along line XV—XV shown in FIG. 6, showing the hatch and magnetic detector.

As shown in FIGS. 6 and 7, a recess 46 is formed in the stabilizer body 50. This recess 46 is enclosed by a cover hatch 48 secured to the stabilizer body by screws 62. An electronics package 60, which includes a printed circuit board and microprocessor, is secured under the hatch 48. As shown in FIGS. 4(*a*) and (*b*), magnets 90 and 92 are located in recesses 38 formed on the opposing sides of the inner surface of the rotatable sleeve 20. A low intensity magnet 90 is located within one of the recesses 38 and a high intensity magnet 92 is located in the other recess. As shown in FIG. 14, a detector 94, capable of sensing the intensity of a magnetic field, is located in a blind hole 95 formed in the underside of the hatch 48.

Figure 4A:
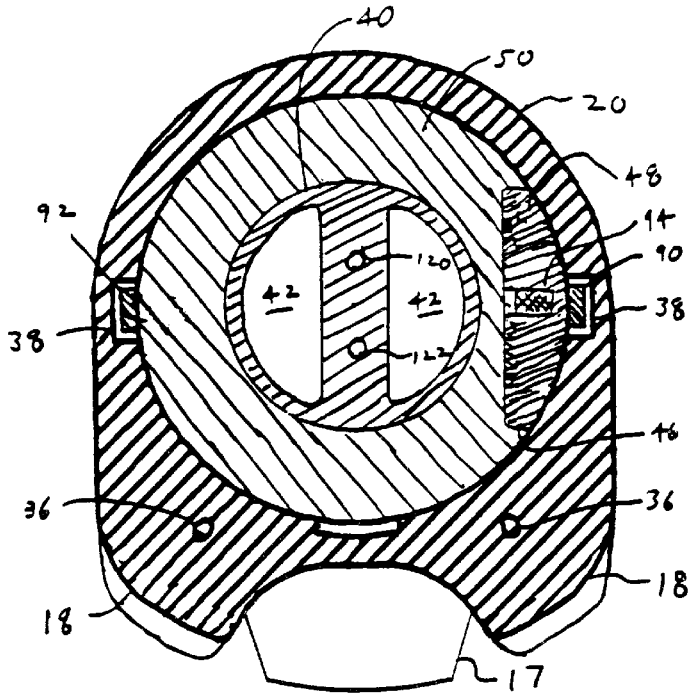
FIGS. 4(*a*) and (*b*) are transverse cross-sections taken along line TV-IV shown in FIG. 2, showing the rotatable blades aligned with the stationary blade (i.e., in the inactive orientation) and opposite the stationary blade (i.e., in the active orientation), respectively.
Figure 4B:
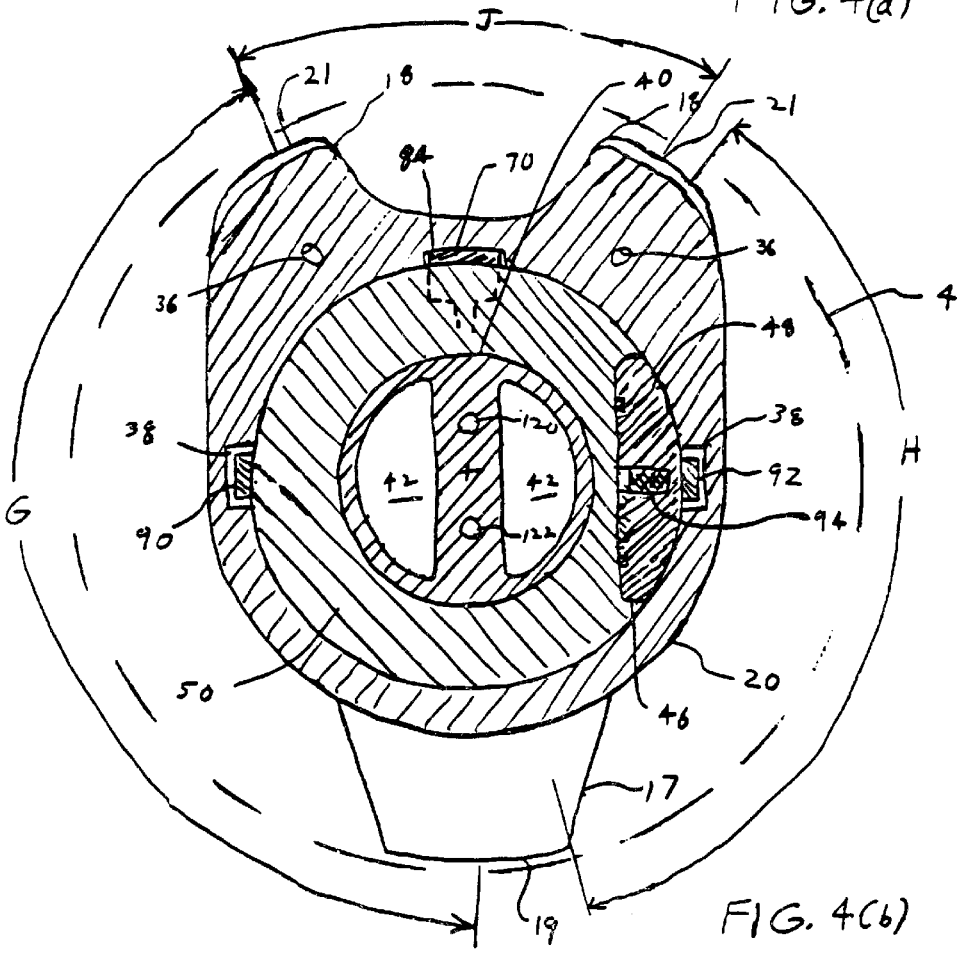

When the rotatable sleeve 20 is rotated so that the midpoint between the blades 18 is approximately aligned with the stationary blade 17—that is, in the inactive orientation—the weak magnet 90 is located adjacent the detector 94, as shown in FIG. 4(*a*). However, when the rotatable sleeve 20 is rotated so that the mid-point between blades 18 is oriented approximately opposite from the stationary blade 17—that is, in active orientation—the strong magnet 92 is located adjacent the detector 94, as shown in FIG. 4(*b*). Thus, by sensing the presence of a weak magnetic field, strong magnetic field or essentially no magnetic field, the angular orientation of the rotatable sleeve 20 can be determined. Accordingly, the detector 94 sends a signal representative of the strength of the magnetic field to the electronics package 60, which processes the information and, employing programed software and other techniques well known in the art, uses the detector signal to determine whether the rotatable blades 18 are oriented into the inactive position, active position, or intermediate position. This information can then be stored in memory within the electronics package 60 for subsequent use, or for subsequent transmission to the surface. Alternatively, information on the orientation of the rotatable sleeve 24 can be transmitted immediately to the surface. Transmission of information to the surface can be accomplished by techniques well known in the art, such as mud pulse telemetry.

As is well known in the art, in mud pulse telemetry systems information from a sensor are typically received and processed in a microprocessor-based data encoder, which, in the current invention, can be incorporated into the electronics package 60, which digitally encodes the information. A controller, which can also be incorporated into the electronics package 60, then actuates a pulser that generates pressure pulses within the flow of drilling mud that contain the encoded information. The pressure pulses can be defined by a variety of characteristics, including amplitude, duration, shape, and frequency. The pressure pulses travel up the column of drilling mud flowing down to the drill bit, where they are sensed by a strain gage based pressure transducer at the surface. The data from the pressure transducers are then decoded and analyzed by the drill rig operating personnel. As is also well known in the art, various pulsers have been developed for generating the pressure pulses in the drilling mud, such axially reciprocating valves or rotary pursers, such as continuously rotating "turbine" or "siren" type pulsers or incremental type pulsers.

Consequently, according to the current invention, information from the detector 94 can be encoded and transmitted the surface via a pulser 29 located in the stabilizer passage 28 through which the drilling mud flows and controlled by software programmed into the microprocessor in the electronics package 60.

Brake Shoe

Another embodiment of the invention is shown in FIG. 19. In that embodiment, a recess 53 is formed in the contact surface 21 of one or more of the rotatable blades 18. A circumferentially extending brake shoe 59 is mounted within the recess 53. One end of the brake shoe is pivotally mounted within the recess 53 by a pivot pin 52 projecting from the wall of the recess. This allows the brake shoe 59 to rotate in a plane perpendicular to the central axis of the stabilizer 1. As viewed in FIG. 19, the brake shoe 59 rotates radially outward in the counterclockwise direction and radially inward in the clockwise direction, while the drill bit (and, therefore, the stabilizer 1 and drill string 27) rotates in the clockwise direction to drill into the formation. (As used herein, the terms clockwise and counterclockwise are used in only a relative sense to refer to opposing rotational directions, it being realized that rotation appearing in the clockwise direction when looking downhole will appear in the counterclockwise direction when looking uphole.)

Radial outward rotation of the brake shoe 59 is limited by a stop pin 54 mounted in the recess 53 and extending through a slot 57 formed through the brake shoe. A spring 58, retained in hole 57 formed in the blade 18, urges the shoe 59 to rotate radially outward in the counterclockwise direction. As the stabilizer 1 rotates in the bore 4 along with the drill bit 5, the outward force applied by the spring 58 assists centrifugal force in urging the shoe to rotate radially outwardly about the pivot pin 52 so that its contact surface 55 engages the wall of the bore 4.

When the stabilizer 1, and hence blade 18, is rotating in the clockwise direction, as indicated by the arrow in FIG. 19, the end of the brake shoe 59 opposite the pivot point forms the leading edge of the shoe and the pivot end forms the trailing edge of the shoe. As is well known in the brake shoe art, contact between the brake shoe 59 and the wall of the bore 4 in this configuration will generate a friction force that tends to urge the shoe to rotate further about the pivot 52 in the counterclockwise direction and thereby drive the shoe further into contact against the wall of the bore. The greater the area of contact between the brake shoe 59 and the wall of the bore 4, the greater the frictional force and the greater the force urging the brake shoe into contact with the wall of the bore. Thus, the brake shoe 29 is preferably "self-energizing" in that even slight contact between the brake shoe 59 and the bore hole wall will drive the brake shoe radially outward so as to increase the force urging the shoe against the wall.

The brake shoe 59 serves to ensure that sufficient frictional resistance is developed between the blades 18 and the bore 4 to ensure that the blades 18 rotate into the active position when released by the actuation mechanism, and subsequently rotate back into the inactive system prior to withdrawal of the stabilizer, as previously discussed.

Formation Sensor

According to one aspect of the invention, the brake shoe 59 can be used as a sensor pad that facilitates sensing information about the formation being drilled through, such as that used in LWD systems. As shown in FIG. 19, a sensor 45 is mounted in a recess 47 formed in the contact surface 55 of the brake shoe 49. The sensor 45 senses information concerning the formation 2 being drill through, such as its density, porosity, electrical resistivity/conductivity, etc., and may be a gamma scintillator, resistivity sensor, or nuclear detectors, for example, or other sensor well known in the field. A cover 39 can be installed over the recess to protect the sensor 45 from damage. The signal from the sensor 45 is sent via a conductor, not shown, extending through passage 49 to the electronics package 60, which processes the signal and prepares it for transmission to the surface using techniques well known in the field, for example, using the mud pulse telemetry system discussed above in connection with the mechanism for determining the circumferential orientation of the rotatable blades.

The use of the brake shoe 59 as a support pad for the sensor 45 ensures that the sensor is placed into contact with, or very close to, the wall of the bore hole 4, thereby ensuring accurate measurements.

Although the sensor 45 is preferably placed in the brake shoe 59, the invention could also be practiced by incorporating the sensor in the distal end of the rotating or stationary blades without benefit of the brake shoe.

The present invention may be embodied in other specific forms without departing from the spirit or essential attributes thereof and, accordingly, reference should be made to the appended claims, rather than to the foregoing specification, as indicating the scope of the invention.

What is claimed:

1. A stabilizer for use in a drill string for drilling a bore hole, comprising:

a) a stabilizer body adapted to be mounted in said drill string;

b) a first stabilizer blade affixed to said stabilizer body, said first stabilizer blade having a distal end adapted to engage said bore hole;

c) a sleeve rotatably mounted on said stabilizer body;

d) at least a pair of circumferentially displaced second stabilizer blades projecting radially outward from said sleeve, said pair of second stabilizer blades rotating in a common circumferentially extending plane axially displaced from said first stabilizer blade; and e) a locking mechanism for locking said sleeve in first and second circumferential orientations, wherein when said sleeve is in said first circumferential orientation, the midpoint between said pair of second blades is substantially axially aligned with said first stabilizer blade.

2. The stabilizer according to claim 1, wherein when said sleeve is in said second circumferential orientation, the midpoint between said pair of second stabilizer blades is substantially opposite said first stabilizer blade.

3. The stabilizer according to claim 1, herein said first and second circumferential orientations are spaced approximately 180° apart.

4. The stabilizer according to claim 1, wherein the centers of said distal ends of said second stabilizer blades are circumferentially displaced by an angle of at least about 60°.

5. The stabilizer according to claim 1, further comprising a sensor mounted in said distal end of at least one of said blades for sensing a property of a formation through which bore hole is drilled.

6. A stabilizer for use in a drill string for drilling a bore hole, and through which a drilling fluid flows, comprising:

a) a stabilizer body adapted to be mounted in said drill string;

b) a sleeve rotatably mounted on said stabilizer body;

c) a stabilizer blade projecting radially outward from said sleeve;

d) a movable locking member, said locking member locking said sleeve into a first circumferential orientation when said locking member is in a first position and unlocking said sleeve when said locking member is in a second position, whereby said sleeve can rotate around said stabilizer body when unlocked;

e) a first piston coupled to said locking member, whereby actuation of said first piston drives said locking member from said first position to said second position, wherein said first piston is actuated by pressure applied by said drilling fluid to said first piston;

f) means for intensifying the pressure applied to said first piston by said drilling fluid, wherein said pressure intensifying means comprises a second piston.

7. The stabilizer according to claim 6, wherein said locking member also locks said sleeve into a second circumferential orientation.

8. The stabilizer according to claim 6, whereby said piston is actuated by the flow of said drilling fluid through said drill string.

9. The stabilizer according to claim 6, wherein said second piston has an enlarged diameter portion and a reduced diameter portion, and wherein said drilling fluid applies pressure to said enlarged diameter portion and said piston reduced diameter portion applies pressure greater than said drilling fluid pressure to said first piston.

10. A stabilizer for use in a drill string for drilling a bore hole, comprising:

a) a stabilizer body adapted to be mounted in said drill string;

b) a sleeve rotatably mounted on said stabilizer body;

c) a stabilizer blade projecting radially outward from said sleeve, said stabilizer blade having a distal end;

d) a pad mounted in said distal end of said stabilizer blade, said pad having first and second ends, a pivot joint pivotally coupling said pad first end to said blade distal end, whereby rotation of said pad about said pivot joint in a first direction displaces said pad second end radially outward so as to contact said bore hole wall.

11. A drill string for use in drilling a bore hole in an earthen formation, said bore hole having a wall, comprising:

a) a drill bit;

b) means for rotating said drill bit in the clockwise direction so as to drill a bore hole in an earthen formation;

c) a stabilizer mounted proximate said drill bit, said stabilizer comprising a housing and a stabilizer blade extending radially outward from said housing, said blade having a distal end;

d) a sensor pad mounted in said distal end of said blade, said sensor pad having first and second ends, said second end being circumferentially displaced from said first end in the clockwise direction, whereby said second end forms a leading edge when said drill string rotates in said clockwise direction, a pivot joint pivotally coupling said first end of said sensor pad to said blade distal end whereby rotation of said sensor pad about said pivot joint in a counterclockwise direction displaces said sensor pad second end radially outward so as to contact and apply a force to said bore hole wall, said contact creating a friction force when said drill string rotates in said clockwise direction that tends to further rotate said sensor pad about said pivot joint in said counterclockwise direction thereby increasing said force applied by said sensor pad second end to said bore hole wall;

e) a sensor mounted in said sensor pad for sensing a property of said formation.

12. The drill string according to claim 11, further comprising a compression spring for urging said sensor pad to rotate around said pivot joint in said counterclockwise direction so as to cause said sensor pad second end to contact and apply said force to said bore hole wall.

13. The drill string according to claim 11, wherein said drill bit comprises an eccentric drilling element.

14. The drill string according to claim 11, further comprising a reaming wing disposed proximate said drill bit.

15. The drill string according to claim 11, wherein said sensor is a resistivity sensor.

16. The drill string according to claim 11, further comprising means for limiting said rotation of said sensor pad about said pivot joint in said counterclockwise direction.

17. An apparatus for use in a drill string for sensing a property of an earthen formation through which said drill string drills a bore hole when said drill string is rotated in a first circumferential direction, said bore hole having a wall, comprising:

a) a housing adapted to be mounted in a drill string;

b) a blade extending radially outward from said housing, said blade having a distal end;

c) a sensor pad mounted in said distal end of said blade, said sensor pad having a circumferentially trailing first end and a circumferentially leading second end when said housing is rotated in the clockwise direction, a pivot joint pivotally coupling said first end of said sensor pad to said blade distal end whereby rotation of said sensor pad about said pivot joint in a counterclockwise direction displaces said sensor pad second end radially outward so as to contact and apply a force to said bore hole wall, said contact creating a friction force when said housing rotates in said clockwise direction that tends to further rotate said sensor pad about said pivot joint in said counterclockwise direction thereby increasing said force applied by said sensor pad second end to said bore hole wall;

d) at least a first sensor mounted in said sensor pad for sensing a property of said formation.

* * * * *

UNITED STATES PATENT AND TRADEMARK OFFICE

CERTIFICATE OF CORRECTION

PATENT NO. : 6,622,803 B2
DATED : September 23, 2003
INVENTOR(S) : Peter R. Harvey et al.

It is certified that error appears in the above-identified patent and that said Letters Patent is hereby corrected as shown below:

Title page,
Item [57], ABSTRACT,
Line 1, delete “an” and insert -- a --;

Column 3,
Line 56, delete “TV-IV” and insert -- IV-IV --.

Signed and Sealed this

Eighth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,622,803 B2
DATED : September 23, 2003
INVENTOR(S) : Peter R. Harvey et al.

It is certified that error appears in the above-identified patent and that said Letters Patent is hereby corrected as shown below:

Title page,
Item [73], Assignee, insert:
-- APS Technology, Inc.,
Cromwell, CT (US) --;

Signed and Sealed this

Twenty-first Day of June, 2005

JON W. DUDAS
*Director of the United States Patent and Trademark Office*